US005109994A

United States Patent [19]

Kidd et al.

[11] Patent Number: 5,109,994

[45] Date of Patent: May 5, 1992

[54] DISPLAY SYSTEM

[75] Inventors: R. Christopher Kidd; Lester W. Morrow, both of New York, N.Y.

[73] Assignee: Marlboro Marketing, Inc., New York, N.Y.

[21] Appl. No.: 487,731

[22] Filed: Mar. 2, 1990

[51] Int. Cl.[5] ..... A47F 5/00

[52] U.S. Cl. ..... 211/162; 211/94; 211/175

[58] Field of Search ..... 211/162, 175, 94; 160/135

[56] References Cited

U.S. PATENT DOCUMENTS 2,098,828 11/1937 Ludwick ..... 211/162 X
4,561,550 12/1985 Franklin ..... 211/189 X
4,657,149 4/1987 Masson ..... 160/135 X
4,707,940 11/1987 Franklin ..... 40/605
4,889,377 12/1989 Hughes ..... 211/162 X
4,898,284 2/1990 Arens ..... 211/94 X
4,982,852 1/1991 Johansen ..... 211/162

*Primary Examiner*—Robert W. Gibson, Jr.
*Attorney, Agent, or Firm*—Darby & Darby

[57] ABSTRACT

A frame having upper and lower tracks having a channel formed therein and a pylon having two angularly arranged panels disposed between the upper and lower tracks. The pylon slides along the channels to occupy any one of a plurality of positions relative to the frame. The pylon is secured in a selected position along the channel. Upper and lower wheels or slidable shoes may be mounted to the pylon to allow sliding of the pylon along the channels.

16 Claims, 6 Drawing Sheets

Fig. 2.
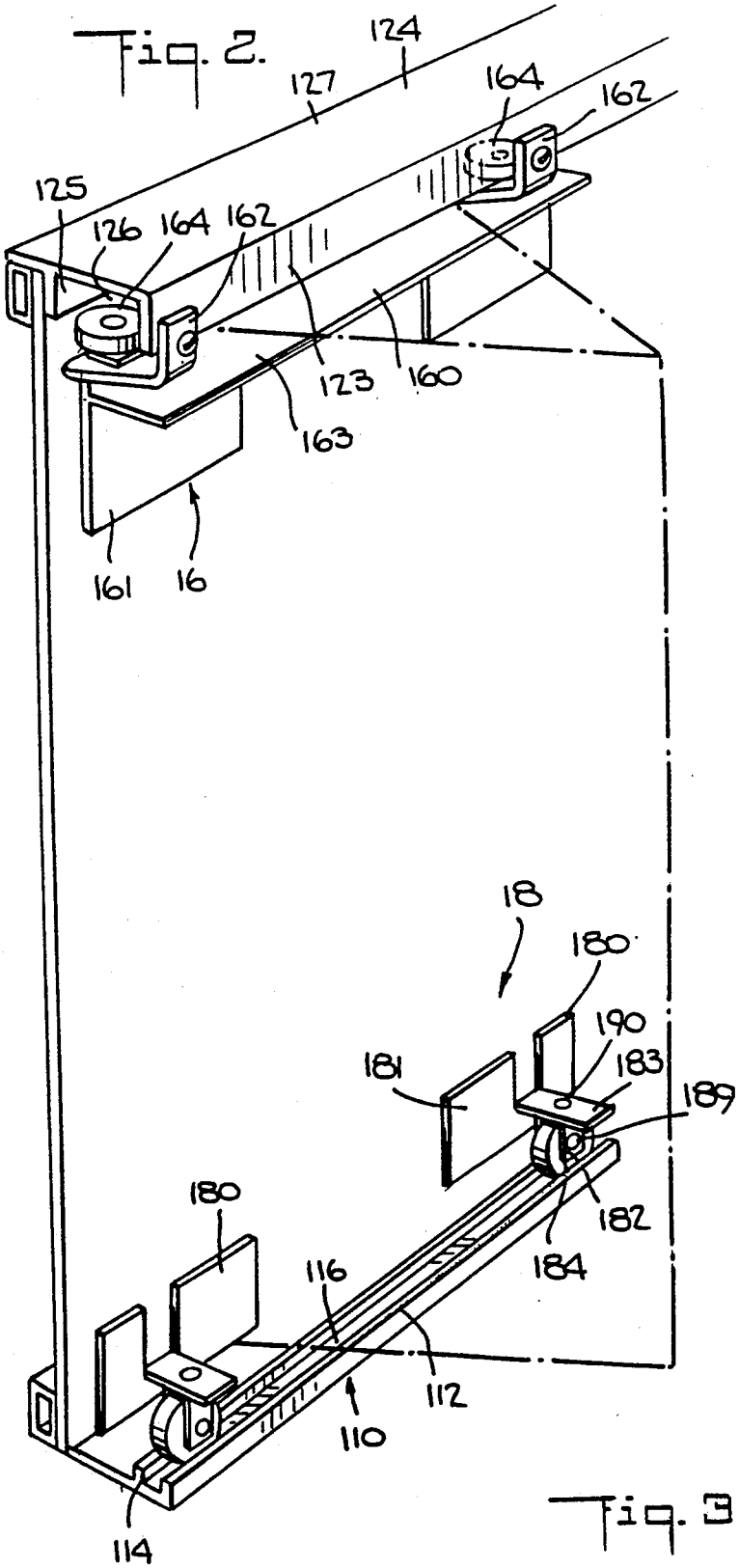
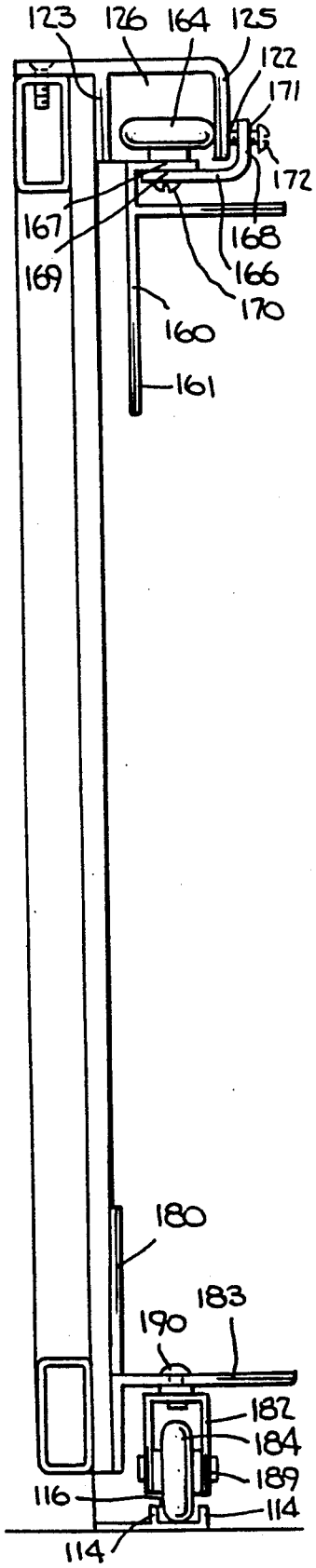
Fig. 3.

DISPLAY SYSTEM

BACKGROUND OF THE INVENTION

This invention relates to a display unit for merchandise and more particularly to a pylon for displaying merchandise or advertisements which can be slid to any one of a number of positions along the display unit.

DESCRIPTION OF THE RELATED ART

There are numerous types of display assemblies to display merchandise and advertisements. One type of display assembly includes planar vertical panels. Another type of display consists of two panels which extend angularly outwardly from the display frame, intersecting at a common edge,(referred to as pylons) so the merchandise or advertisements can be viewed from the sides of the display. These outwardly extending panels allow for more merchandise to be displayed than the vertical panels since they provide two display surfaces instead of one. They also provide for a more decorative display than do vertical panels because the display is in multiple planes. U.S. Pat. No. 3,559,814 discloses a display assembly having both outwardly extending panels and a rear panel. Rectangular shaped blanks are hinged together to form two separate foldable panels. U.S. Pat. No. 4,428,136 also discloses angularly arranged panels hinged together. Although these assemblies allow for merchandise and advertising to be displayed on both angular and vertical panels, these assemblies lack versatility in placement within the display, because the panels are secured in set positions and cannot be rearranged. Since the display of merchandise and advertisements is extremely important for sales, the inability to easily rearrange the display as desired is a major disadvantage. It would be extremely advantageous if a display unit could be provided which allowed for easy rearrangement of the angular panels (pylons) into any one of a plurality of positions within the display unit.

SUMMARY OF THE INVENTION

The present invention in one respect is directed to a frame having upper and lower tracks having a channel formed therein, a pylon having two angularly arranged panels disposed between the upper and lower tracks, and means for sliding the pylon along the channels to occupy a plurality of positions in the frame. Locking means may be provided to secure the pylon in a selected position along the channel. Upper and lower wheels or slidable shoes may be provided to allow sliding of the pylon along the channels.

BRIEF DESCRIPTION OF THE DRAWINGS

Various objects, features and attendant advantages of the present invention will be more fully appreciated as the same becomes better understood from the following detailed description of the preferred embodiment of the present invention when considered in connection with the accompanying drawings, in which:

FIG. 2 is a front perspective view showing a first embodiment of upper and lower assemblies mounted in the upper and lower tracks of the present invention;

FIG. 3 is a side view showing the upper and lower wheel assemblies mounted in the upper and lower tracks of the present invention.

DETAILED DESCRIPTION OF THE PREFERRED EMBODIMENTS

Figure 1:
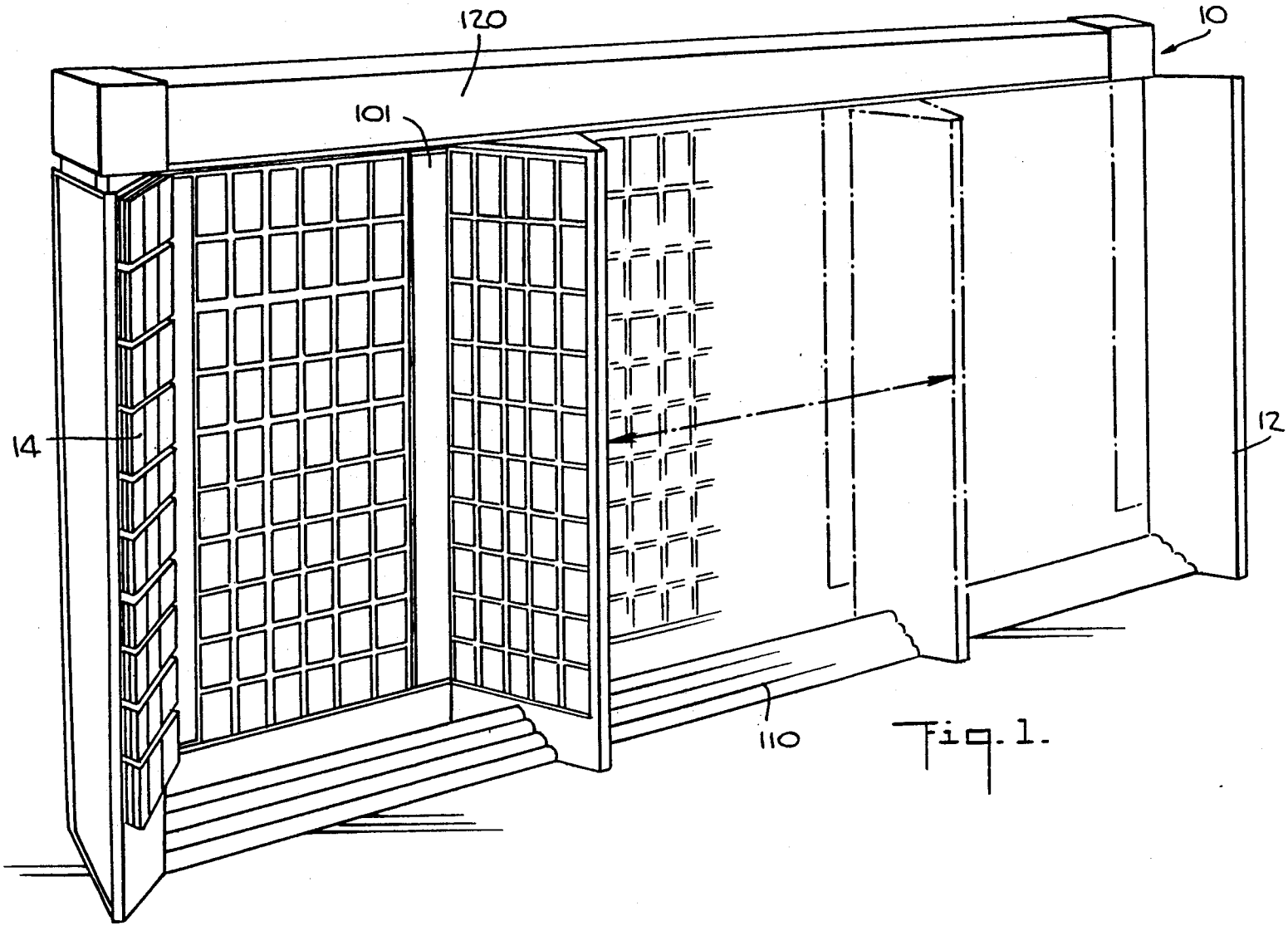
FIG. 1 is a front perspective view of the display assembly showing a plurality of pylons disposed within the frame.

Referring now to the drawings wherein like reference numerals represent identical or corresponding parts throughout the several views, and more particularly to FIG. 1, display assembly 1 comprises a frame 10 supporting a plurality of pylons 12. The pylons 12, as is conventional, are of substantially triangular cross section and are formed by two converging angled panels intersecting in a front vertical edge. Merchandise and advertisements can be displayed on one or both panels of the pylons.

Frame 10 comprises an upper support 120, a lower support 110 and a vertical supports 101 joining upper and lower supports 120, 110. Each pylon 12 is supported between upper and lower supports 120, 110 and between vertical supports 101. Although four pylons are shown in FIG. 1, a larger or a smaller number of pylons can be used with display assembly 1.

As shown in FIGS. 2 and 3, which show a first embodiment of the invention, the upper and lower supports 120, 110 of frame 10 of the present invention are provided with an upper track 124 and lower track 116, respectively. Tracks 124, 116 receive an upper wheel assembly 16 and a lower wheel assembly 18, respectively, which advantageously allows for sliding movement of the pylon 12. That is, upper and lower wheel assemblies 16, 18 are attached to pylon 12 and received in tracks 124, 116 so pylon 12 can be slid along the frame to a desired position.

Turning first to the upper support 120 and upper wheel assembly 16 of the present invention, as shown in FIGS. 2 and 3, upper track 124 of upper support 120 has a top wall 127, and downwardly extending parallel rear and front walls 125, 123 which form a channel 126 therebetween. Channel 126 preferably extends across the entire length of track 124, and faces downwardly towards lower support 110. Two apertures 122 are formed in front wall 123 of upper track 104.

With continued reference to FIGS. 2 and 3, upper wheel assembly 16 comprises an upper mounting bracket 160, two locking brakes 162 mounted on opposing sides of upper mounting bracket 160, and two upper wheels 164. Upper bracket 160 is F-shaped as it comprises a vertical wall 161, a horizontal wall 163 perpendicular to vertical wall 161, and a horizontally extending flange 165 spaced in parallel relationship above horizontal wall 163 along the top edge of vertical wall 161. An aperture 167 is formed in both ends of flange 165.

Each locking brake 162, curved L-shape in configuration, includes a bottom wall 166 and a side wall 168. An opening 169 is formed in bottom wall 166 of locking brake 162 and is placed in underlying alignment with aperture 167 of flange 165. A fastening member 170, such as a screw or bolt, is inserted through aligned aperture 167 and opening 169 to maintain upper wheel 164 in channel 126. An opening 171 is also formed in side wall 168 of locking brake 162. Fastener 172, such as a screw or bolt, extends through opening 171 to contact front wall 123 of upper track 124.

Upper wheel 164 is disposed horizontally in channel 126, spaced below top wall 127, and preferably has a diameter sufficiently less than the width w of channel 126 so that a gap is formed between upper wheel 164 and rear wall 125 of upper track 124.

Turning now to lower support 110 and lower wheel assembly 18 of the present invention, lower track 112 of lower support 110 has a pair of upwardly extending parallel walls 114 which form a narrow channel 116 therebetween. As with upper track 104, channel 116 preferably extends along the entire length of lower track 112. Narrow channel 116 receives a lower wheel 184.

Lower wheel assembly 18 includes two lower brackets 180, two U-shaped supports 182 and two lower wheels 184. Each lower bracket 180 has an upright wall 181 having a perpendicular extension 183 which has an opening 185 formed therein. U-shaped support 182 is secured below extension 183 by a bolt or screw 190, or any other fastening means. Lower wheel 184 is received within U-shaped support 182 and is maintained in position by fasteners 189.

As can be seen from the drawings, the lower wheel assembly 18, and particularly lower wheel 184 is the mechanism used to slide pylon 12 along frame 10 as lower wheel 184 sits in channel 116 of lower track 112. Upper wheel assembly 16 is used to restrict forward and rearward movement of pylon 12 as upper wheel 164 is seated width-wise between the front and rear walls 123, 125 of upper track 104. Upper wheel assembly 16 also provides for securing pylon 12 in position once pylon 12 is moved to its desired location as fastening elements 172 of locking brakes 162 is tightened against front wall 123 of track 104.

In operation, to slide pylon 12 to a new position inside frame 10, fastening elements 172 are loosened to release locking brake 162 to allow for movement of upper wheel 164. Lower wheels 184 are slid along narrow channel 116 of tracks 112, towards either the left or right side of the display, to a desired position for displaying the merchandise. Upper wheels 164 simultaneously move within channel 126. Once pylon 12 is slid to the desired position, fastening elements 172 are tightened to press against the front wall 123 of upper track 124 so that locking brakes 162, which are secured to upper wheel 164, prevent further sliding of pylon 12.

In the embodiment of the present invention described above, the upper wheel assembly 16 provides for locking pylon 12 in place while the lower wheel assembly 18 provides for sliding the pylon. In an alternate embodiment, the functions of these assemblies are interchanged so that the upper wheel assembly provides for sliding the pylon and the lower wheel assembly provides for locking the pylon in place. Therefore, in this alternate embodiment, the upper wheel will be disposed in an upright position in a narrow channel while the lower wheel will be in a horizontal position disposed in an upper channel.

Additionally, although only two upper wheels and the lower wheels are shown in the drawings, the present invention is not limited to this number of wheels. A fewer or greater number of upper and lower wheels can be utilized to achieve the functions of the present invention.

An alternate embodiment of the assemblies for supporting and allowing sliding of the nylons is shown in FIGS. 4–9.

Turning to FIGS. 4–10, another embodiment is depicted which replaces the upper and lower wheel assemblies 16, 18 by upper and lower slidable shoes 200 which respectively slide along upper and lower tracks 202, 204. The upper and lower shoes are attached to pylon 12 and are identical to each other. For stability, preferably there are two upper slidable shoes which slide along the upper track 202 and one lower slidable shoe which slides along the lower track 204 and guides the pylon 12. However, any number of shoes may be employed.

Surprisingly, a little extra friction afforded by the shoes as compared to the wheels is actually beneficial for ease of positioning of the pylon 12 into its desired location.

The upper track 202 has an extension 212 with a rounded end 210. The lower track 204 has an extension 214 which is used as a guide for the pylon 12 as the pylon is moved into a desired position by sliding the upper slidable shoe along the upper track.

The upper and lower slidable shoes have a base 230 and two projections 232, 234 extending parallel to each other from the same side of the base 230 and in the same direction so as to define a U-shape therebetween, one projection being longer than the other. When the pylons 12 extend between the upper and lower tracks 202, 204 in position, the curved base of the U-shape between the projections 232, 234 of the upper slidable shoes rests on the rounded end 210 of the extension 212 of the upper track 202 and conforms in shape to this rounded end 210. The curved base of the U-shaped between the projections of the lower slidable shoe does not actually rest on extension 214 unlike that of the upper shoe resting on the rounded end 210 of the upper track, even though in both cases, projections 232, 234 extend on either side of a free wall or extensions 212, 214 the respective upper and lower tracks 202, 204.

Figure 6:
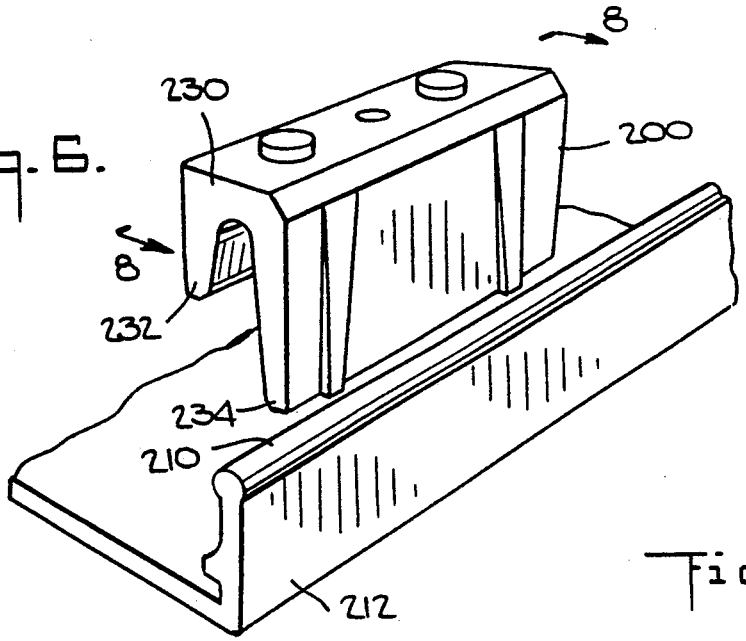
FIG. 6 is a perspective view of a slidable shoe and perspective view of a portion of the upper track of FIG. 5 prior to assembly.
Figure 8:
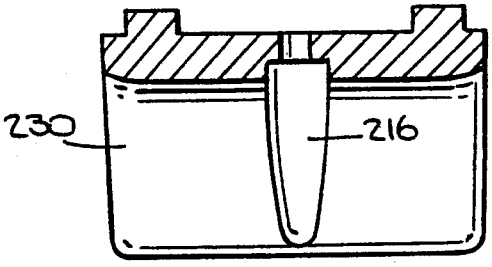
FIG. 8 is a cross-section across lines 8—8 of FIG. 6.
Figure 9:
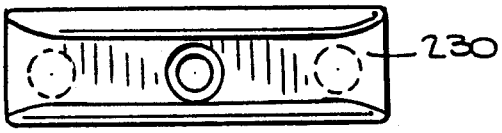
FIG. 9 is a bottom plan view of the slidable shoe of FIG. 6.
Figure 7:
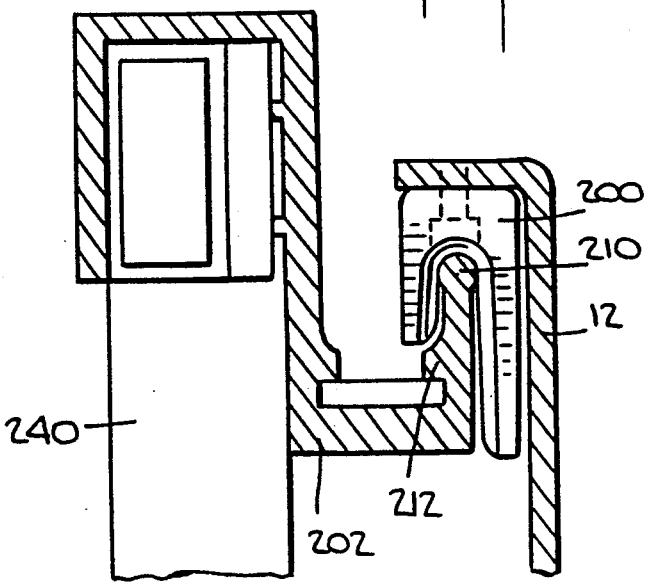
FIG. 7 is an enlarged cross-section of the track and end view of the slidable shoe of FIG. 5 after assembly.
Figure 10:
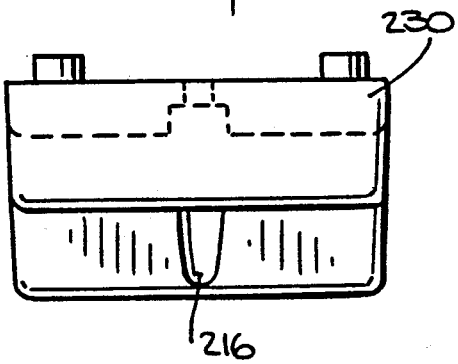
FIG. 10 is a side plan view of the slidable shoe as viewed opposite that depicted in FIG. 6.

Further, provision is made on an outer surface of base 30 for securing the shoe to the pylon 12 as shown in FIGS. 6 and 7. In addition, the inner surface of the projections 232, 234 preferably conforms in shape to the outer surface of the extension 212 beneath the rounded end 210 so as to limit clearance.

Surprisingly, when the weight of the pylon 12 is carried by the upper track instead of the lower track, it is easier to remove or put the pylon in position between the upper and lower tracks.

The upper slidable shoe has a centered groove 216 extending along the length of the longer projection 234. This groove widens as it extends further away from the free end of the longer projection 234. It is intended to accommodate insertion of a fastening screw through the hole at the end of the groove to fasten the pylon 12 by guiding the screw and providing sufficient clearance for the screw head between the projections 232, 234. Projection 232 has a similar groove opposite and facing centered groove 216. The screw head does not pass through the hole; only the stem has sufficient clearance to be inserted through the hole.

The reason that projection 234 is longer than projection 232 is for ease of assembly in guiding placement of the shoe onto the upper track and so that when longer screws are used for fastening, the screw does not rub against the pylon to scratch its finish during insertion. The shoes are made of an acetal, which is a type of plastic.

Supporting the upper and lower tracks is a support frame 240. This frame slidably holds a light fixture support 242, which is movable toward and away from the upper track into any one of a plurality of positions. Once a desired position is selected, locking elements 244 are used to lock the light fixture support 242 into position to the frame 240. The locking elements may be any conventional type of fasteners, such as a fastening screw and nut. There is also a lower support 110 which provides added stability for the frame 240 by extending underneath and forward of the lower track.

A projection 246 extends over the upper track and at least between the pylons to secure a hollow body 248 in position. The body 248 is simply pushed onto projection 246 into the position shown. This body contains a light source 250 which runs the length of the body in the direction of elongation of the tracks. The body 248 preferably has a plate of transparent or translucent diffusion glass or plastic for its underside wall to allow the light to transmit to illuminate the display underneath.

If desired, a sign identifying the display is illuminated forward and above the upper track by the same light source 250. In this case, the sign is located adjacent the lens 254 and between the lens 254 the body 248 and thereby the light source 250. The sign may be in the form of a colored translucent strip with opaque lettering. The strip extends the full height and length of the lens so that direct viewing of the light source 250 through the lens from outside the display is not possible when the strip is in position. The remaining walls of the body 248 are opaque.

Figure 4:
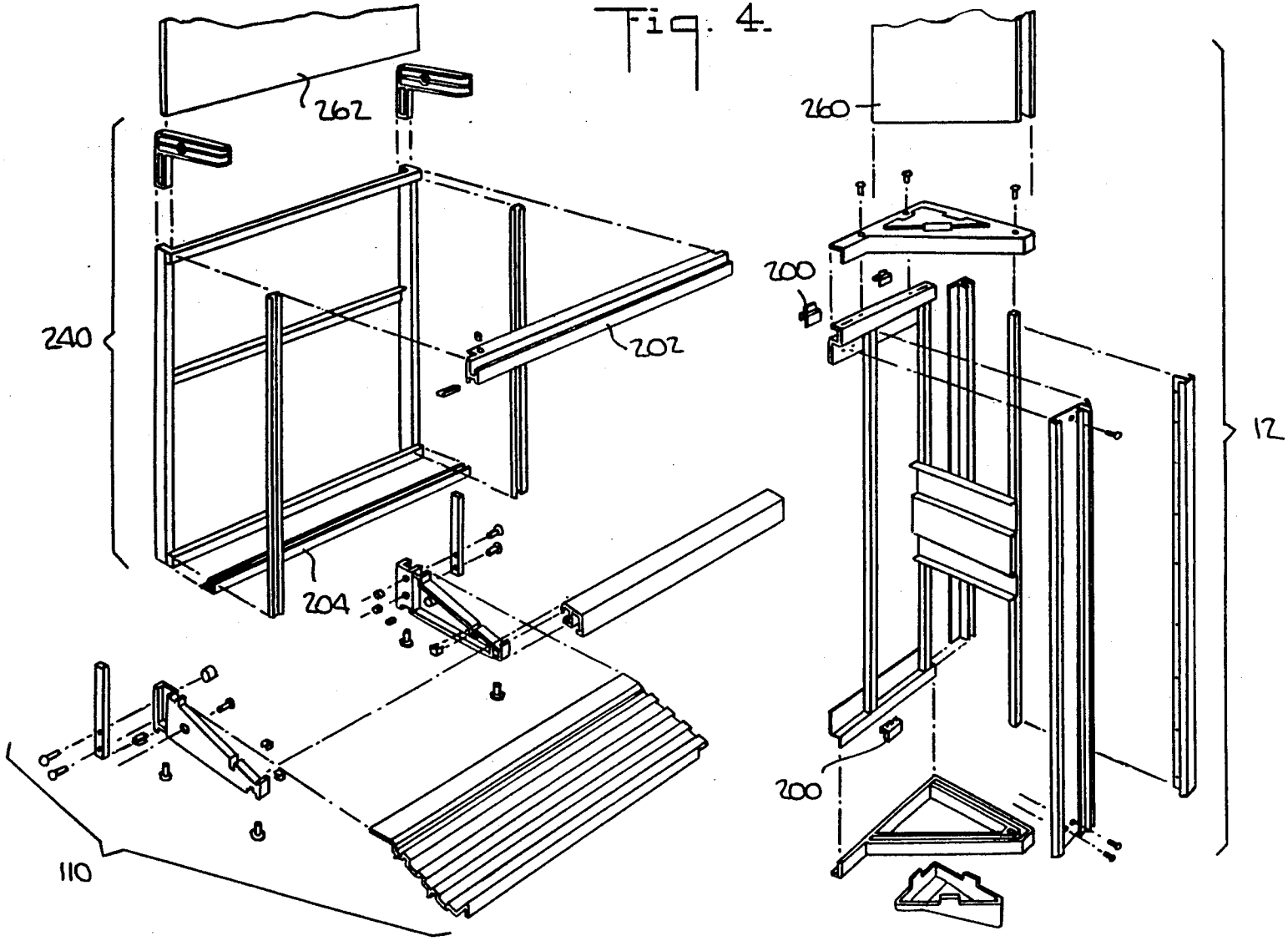
FIG. 4 is an exploded perspective view of another embodiment of the present invention prior to assembly.
Figure 5:
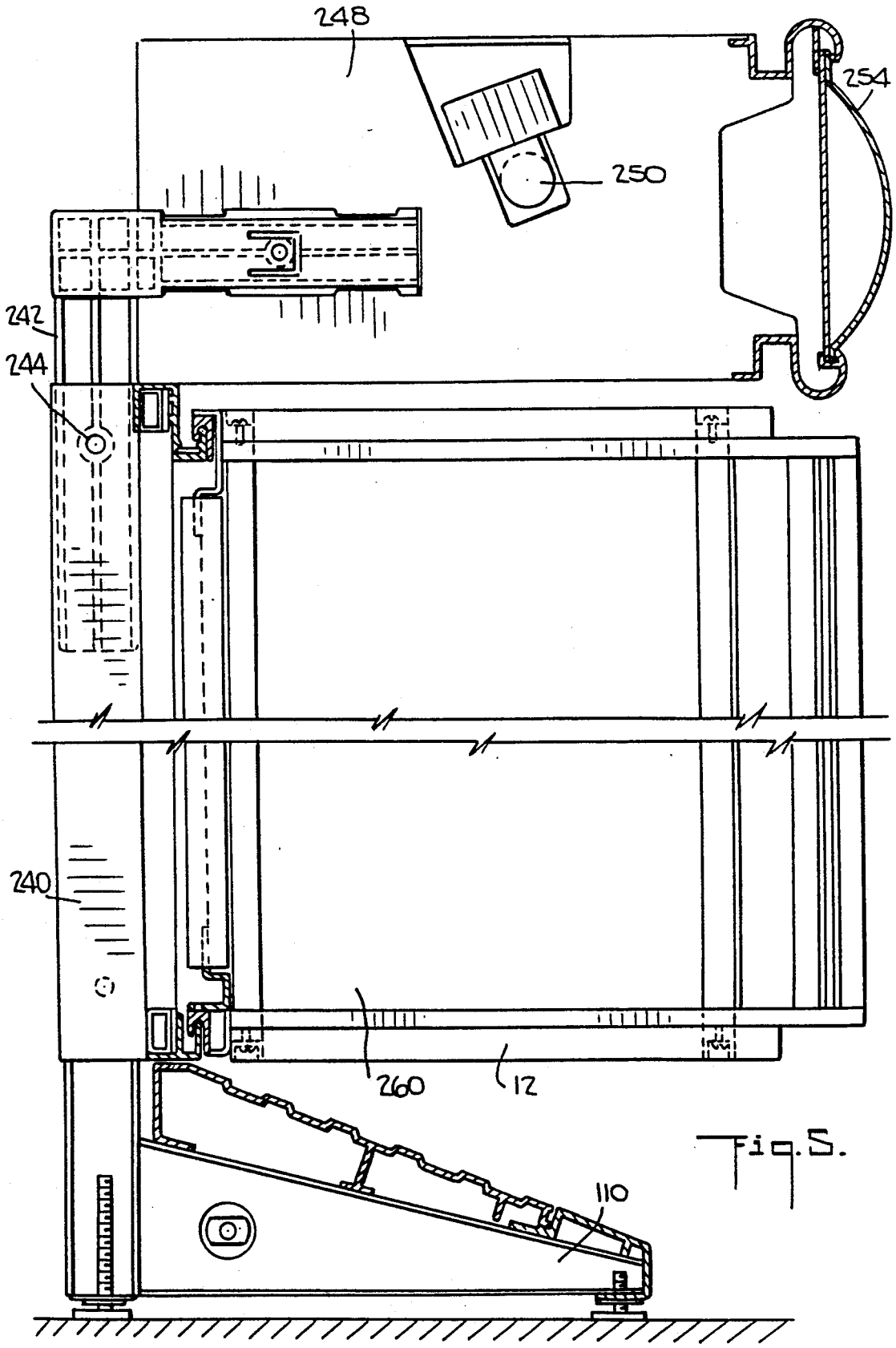
FIG. 5 is a side view of FIG. 4 after assembly.

FIG. 4 is self-explanatory in showing the manner in which the various components are put together to form the frame 240, lower support 110 and pylon 12. Display panels 260, 262 are inserted into position in the manner shown.

Figure 11:
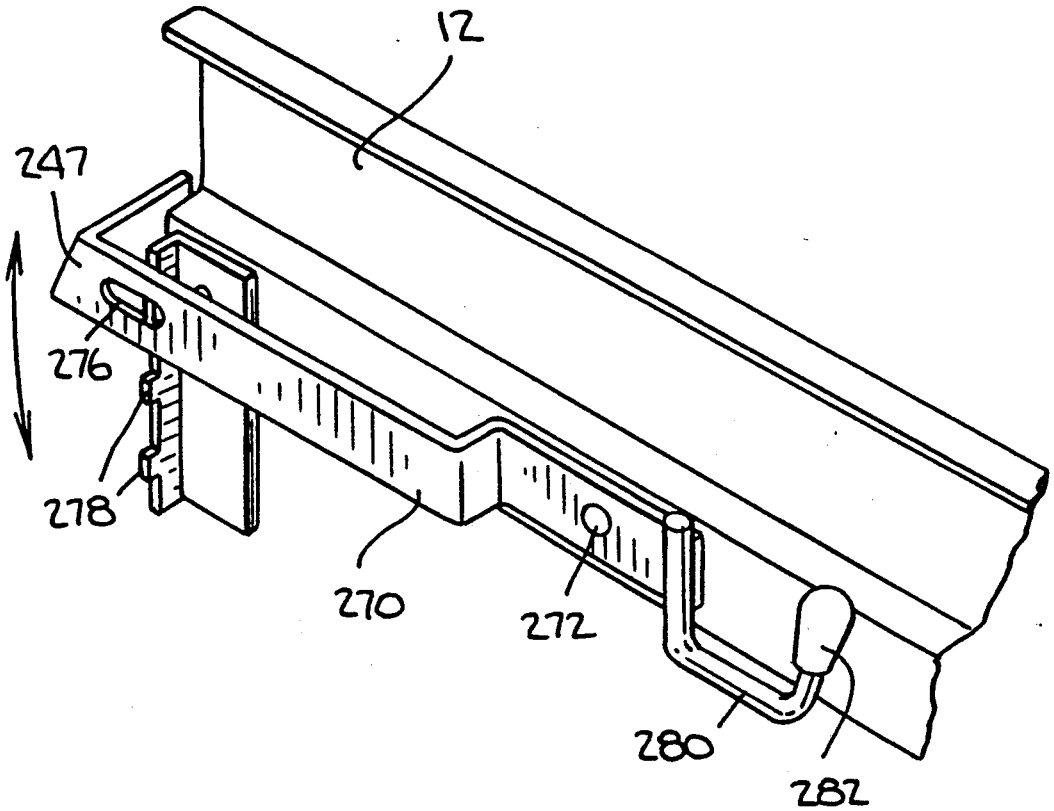
FIG. 11 shows a perspective view of a locking mechanism for the embodiment of FIGS. 4–10.

FIG. 11 shows a locking mechanism which has a lever 270 pivotably connected to the uppermost beam of pylon 12 at pivot 272 and at an elevation lower than that of the upper shoe. One end 274 of the lever 270 may be secured into any one of three positions in which its elongated opening 276 is fitted around one of three notches 278 of the pylon 12. The movement of end 274 causes the opposite hooked end 280 to move as well about the pivot 272 into any one of three corresponding positions. The extreme end of the hooked end 280 has a rubber cap 282. When the opening 276 is around the uppermost notch, the rubbercap 282 is in its lowest position and the pylon may be positioned onto the tracks via the shoes without clearance problems. When the opening 276 is moved to the middle notch, the rubber cap 282 raises to a position in which sliding of the pylon may be effected along the tracks without the hooked end 280 inadvertently causing the shoe to fall off the tracks into misalignment. When the opening 276 is moved to the lowest notch, the rubber cap 282 is at its highest position and contacts the underside of the upper track, thereby creating friction between the upper track and pylon. In this manner, the pylon locks into position due to this friction. The pylon may be released from the locked position by pivoting the lever and thereby moving the opening away from this lower notch. Preferably, the lever 270 is biased into the locking position and pivotably movable out of the locking position in a direction against the biasing.

Although this embodiment shows that support is provided by the upper slidable shoes resting on the upper track, it should be understood that this arrangement may be interchanged or supplemented with the lower slidable shoe resting on the lower track instead. If desired, the upper slidable shoes may simply be guided by the upper track rather than supported, in which case the lower slidable shoe and lower track would cooperate with each other to provide all the necessary support.

Further, components of one embodiment which are not shown to have a counterpart in the other embodiment may be freely added in the same manner as in the one embodiment. Also, components of one embodiment which have a counterpart in the other embodiment may be exchanged with each other.

It will be appreciated that the instant specification and claims are set forth by way of illustration and not limitation, and that various modifications, additions or substitutions may be made without departing from the spirit and scope of the present invention.

I claim:

1. A display unit for merchandise comprising upper and lower tracks, each of said tracks having a channel formed therein;

a pylon having two angularly arranged panels disposed between said upper and lower tracks; and upper and lower wheels secured to said pylon and slidingly received in said respective upper and lower channels to provide for sliding said pylon along said channels, locking means secured to one of either of said upper or lower wheels for locking said pylon in a selected position along said channel.

2. A display unit as recited in claim 1, wherein said locking means comprises a locking brake disposed adjacent either of said upper or lower tracks.

3. A display unit as recited in claim 2, further comprising a fastening member to secure said locking brake against one of said upper or lower tracks.

4. A display unit for merchandise comprising:

a frame having an upper track and a lower track, at least one of said tracks having a channel formed therein, said channel being defined by at least one free wall;

a pylon having two angularly arranged panels disposed between said upper and lower tracks; and means for sliding said pylon along said channel to occupy any one of a plurality of positions relative to said frame, said sliding means including a shoe resting on said free wall, said shoe having a shoe projection which extends into said channel, said shoe being slidable back and forth on said free wall.

5. A display unit as recited in claim 6, wherein said shoe includes another projection extending parallel to said shoe projection from a common side of said shoe, said free wall extending between said shoe projection and said another projection, said shoe having an inner wall portion extending between said shoe projection and said another projection which conforms in shape to an end of said free wall to facilitate sliding.

6. A display unit as recited in claim 5, wherein said another projection is longer than said shoe projection.

7. A display unit as recited in claim 4, further comprising means for securing said pylon into any one of a plurality of positions relative to said channel.

8. A display unit as recited in claim 4, further comprising means for guiding said pylon as said pylon slides along said channel, said guiding means including another shoe having a shoe projection extending into another channel of said lower track.

9. A display unit as recited in claim 8, wherein said another channel has a free wall with an end which is free of contact with said another shoe.

10. A display unit as recited in claim 8, wherein said shoe and said another shoe are identical to each other.

11. A display unit as recited in claim 9, wherein said another shoe has another projection extending parallel to said shoe projection of said another shoe, said free wall of said another channel extending between said shoe projection of said another shoe and said another projection of said another shoe.

12. A display unit as recited in claim 4, further comprising means for illuminating said pylon, said illuminating means being supported by said frame.

13. A display unit as recited in claim 7, wherein said securing means includes a lever pivotable into any one of three positions and pivotably connected to said pylon, said lever having an end which contacts said channel when said lever is in a first of said three positions so as to prevent said shoe from sliding further relative to said channel, said end of said lever being free of contact with said channel which may otherwise cause said shoe to misalign with respect to said channel when said lever is in a second of said three positions, said end of said lever being free of interfering with placement of said pylon into position for sliding along said channel when said lever is in a third position of said three positions.

14. A display unit for merchandise comprising:

a frame having an upper track and a lower track, one of said tracks having a channel formed therein;

a pylon having two angularly arranged panels disposed between said upper and lower tracks;

means for sliding said pylon along said channel to occupy a plurality of positions relative to said frame, said sliding means including a rotatable wheel secured to said pylon and slidably received within said channel; and locking means for securing said pylon in a desired position along said tracks, said locking means comprising a locking brake and a fastening element, said fastening element extending through said locking brake and pressing against said upper track.

15. A display unit for merchandise comprising:

a frame having an upper track and a lower track, one of said tracks having a channel formed therein;

a pylon having two angularly arranged panels disposed between said upper and lower tracks;

means for sliding said pylon along said channel to occupy a plurality of positions relative to said frame, said sliding means including a rotatable wheel secured to said pylon and slidably received within said channel; and locking means for securing said pylon in a desired position along said tracks, said locking means comprising a locking brake and a fastening element, said fastening element extending through said locking brake and pressing against said lower track.

16. A display unit for merchandise comprising:

a frame having an upper track and a lower track, one of said tracks having a channel formed therein;

a pylon having two angularly arranged panels disposed between said upper and lower tracks;

means for sliding said pylon along said channel to occupy a plurality of positions relative to said frame, said sliding means including a rotatable wheel secured to said pylon and slidably received within said channel; and a mounting bracket for supporting said rotatable wheel for sliding movement within said channel, said mounting bracket having a flange to allow access to said wheel.

* * * * *